US012234061B2

(12) United States Patent
Krautkramer

(10) Patent No.: US 12,234,061 B2
(45) Date of Patent: Feb. 25, 2025

(54) CONTAINER CLOSURE HAVING A HINGE AND A GRIP PROJECTION

(71) Applicant: BERICAP HOLDING GMBH, Budenheim (DE)

(72) Inventor: Gunter Krautkramer, Budenheim (DE)

(73) Assignee: BERICAP HOLDING GMBH, Budenheim (DE)

( * ) Notice: Subject to any disclaimer, the term of this patent is extended or adjusted under 35 U.S.C. 154(b) by 0 days.

(21) Appl. No.: 18/006,392

(22) PCT Filed: Jul. 23, 2021

(86) PCT No.: PCT/EP2021/070735
§ 371 (c)(1),
(2) Date: Jan. 23, 2023

(87) PCT Pub. No.: WO2022/023219
PCT Pub. Date: Feb. 3, 2022

(65) Prior Publication Data

US 2023/0264865 A1 Aug. 24, 2023

(30) Foreign Application Priority Data

Jul. 25, 2020 (DE) ..... 102020119665.2

(51) Int. Cl.
*B65D 41/18* (2006.01)
*B65D 55/16* (2006.01)

(52) U.S. Cl.
CPC ..... *B65D 41/185* (2013.01); *B65D 55/16* (2013.01); *B65D 2251/01* (2013.01); *B65D 2251/105* (2013.01)

(58) Field of Classification Search
CPC .. B65D 41/185; B65D 55/16; B65D 2251/01; B65D 2251/105; B65D 2401/30; B65D 47/0814; B65D 41/485
See application file for complete search history.

(56) References Cited

U.S. PATENT DOCUMENTS

| | | | | |
|---|---|---|---|---|
| 2011/0089187 | A1 | 4/2011 | Steiger et al. | |
| 2021/0206545 | A1* | 7/2021 | Krautkramer | B65D 51/1661 |
| 2022/0234791 | A1* | 7/2022 | Koenigseder | B65D 41/485 |

FOREIGN PATENT DOCUMENTS

| | | |
|---|---|---|
| DE | 20003011 U1 | 7/2000 |
| EP | 3305680 B1 | 9/2019 |

(Continued)

OTHER PUBLICATIONS

International Search Report and Written Opinion mailed Oct. 26, 2021, in connection with International Patent Application No. PCT/EP2021/070735, 13 pgs. (including translation).

(Continued)

*Primary Examiner* — Shawn M Braden
(74) *Attorney, Agent, or Firm* — Chiesa Shahinian & Giantomasi PC

(57) ABSTRACT

A container closure including a retaining ring which extends around a reference axis of the container closure, a cap part and a hinge which connects the retaining ring to the cap part. The cap part has an end plate, an enclosing circumferential wall and a grip projection which extends radially outward from the circumferential wall, axially with a distance to the end plate. A deformable region of the circumferential wall extends diametrically opposite the hinge, between the end plate and the grip projection, and has a latching projection directed radially inward, a lower wall section which lies between the latching projection and the grip projection and an upper wall section which lies between the latching projection and the end plate.

16 Claims, 3 Drawing Sheets

(56) References Cited

FOREIGN PATENT DOCUMENTS

| | | | |
|---|---|---|---|
| FR | 2531931 | A1 | 2/1984 |
| GB | 2125386 | B | 10/1985 |
| WO | 2007/080000 | A1 | 7/2007 |
| WO | 2015/066673 | A1 | 5/2015 |
| WO | 2019/113681 | A1 | 6/2019 |
| WO | 2021174335 | A1 | 9/2021 |

OTHER PUBLICATIONS

Communication pursuant to Article 94(3) EPC mailed Jan. 4, 2024 in connection with European Patent Application No. 21746754.7, 11 pgs. (including translation).

* cited by examiner

CONTAINER CLOSURE HAVING A HINGE AND A GRIP PROJECTION

CROSS-REFERENCE TO RELATED APPLICATIONS

This application is a National Stage under 35 U.S.C. 371 of International Patent Application No. PCT/EP2021/070735, filed Jul. 23, 2021, which claims priority from German Patent Application No. 102020119665.2, filed Jul. 25, 2020; the disclosures of all of which are incorporated herein by reference in its entirety.

FIELD OF USE OF THE INVENTION

The invention relates to a container closure comprising a retaining ring that extends around a reference axis of the container closure, a cap part and a hinge, which connects the retaining ring to the cap part, the cap part comprising an end plate, a circumferential wall that surrounds the end plate and a gripping projection, which extends radially outward from the circumferential wall and extends axially at a spacing from the end plate. The invention also relates to a container that is closed using such a closure.

FORMER PRIOR ART

WO 2007/080000 A1 discloses a container closure of the type mentioned at the outset, wherein the snap hinge is integrated in the circumferential wall and wherein the retaining ring and the cap part are connected to one another next to the snap hinge along a second circumferential portion by means of a tear-off strip. In order to provide such a closure that, even after the first time it is opened, can be tightly re-sealed in a more effective, and above all more simple, manner during use, the circumferential wall comprises a retaining bulge that protrudes inward and on average comprises a greater radial thickness in a sector that is diametrically opposite the center of the snap hinge than within the sectors that are displaced by approximately 90° with respect to the center of the snap hinge. During engagement, the retaining bulge produces a haptic signal that informs the user that the closed position has been reached.

The gripping projection is arranged in the same sector. In order to provide enough space for the tear-off strip, the retaining bulge and the gripping projection, the closure comprises a minimum height that does not permit the end plate to be directly attached to the upper edge of the container neck. Precautions thus have to be taken to ensure that the container closures are not destroyed when containers are deposited one on top of the other. Furthermore, a smaller spacing has to be maintained between the gripping projection and the end plate in the axial direction than the axial spacing between the pivot axis of the snap hinge and the end plate. In order to reduce the height of the container closure, it would be expedient to replace the tear-off strip with a simple dividing line. However, there would then not be enough space to provide the retaining bulge between the retaining ring and the gripping projection.

EP3305680 discloses a container closure of the type mentioned at the outset, wherein the cap part comprises a tab transversely to the gripping projection that comprises a radial inward projection that directly adheres to the neck of the container by means of a cut-out on the upper rim of the retaining ring. This securely holds the container closure in the closed position. When closing the closure, an audible "click" is given that informs the user that the closed position has been reached. When opening it, the user presses the gripping projection upward and the adhesive power between the inner projection and the neck is reduced by a leverage effect such that the force required to open the closure remains limited. This compact structure makes it possible to directly attach the lower surface of the end plate to the upper edge of the container neck.

However, the cut-out on the upper edge of the retaining ring has proven to be a weak point that can make it more difficult to mount the closure on the neck of the container. It is therefore proposed to compensate for this weak point by means of an additional reinforcement in the form of an inner circumferential bulge on the lower rim of the retaining ring. The lower rim of the retaining ring then does not have a rotationally symmetrical shape, which leads to other difficulties when mounting the closure on the neck of the container.

SUMMARY OF THE INVENTION

The object of the invention is to equip a container closure of the type mentioned at the outset with means that provide a haptic or audible signal when it is closed, without adversely affecting the way in which the closure is mounted on the container and without adversely affecting the height of the closure.

In a container closure composing a retaining ring, which extends around a reference axis of the container closure, a cap part and a hinge that connects the retaining ring to the cap part, wherein the cap part comprises an end plate, a circumferential wall that surrounds an inner surface of the end plate and a gripping projection that extends radially outward from the circumferential wall and extends axially at a spacing from the end plate, the object is achieved by the circumferential wall comprising, in a deformable region that is diametrically opposite the hinge and extends between the end plate and the gripping projection, an engagement projection that is directed radially inward, a lower wall portion that is arranged between the engagement projection and the gripping projection and an upper wall portion arranged between the engagement projection and the end plate, a wall thickness of the upper wall portion and a wall thickness of the lower wall portion being determined such that elastic deformation of the deformable region allows for a radially outward movement of the engagement projection by more than fifty percent, preferably more than ninety percent, preferably at least one hundred percent of a radial extension of the engagement projection.

Since the inner engagement projection lies axially between the gripping projection and the end plate, the end plate can be arranged very closely to the engagement projection and therefore also very closely to the container neck without having to reduce the height of the retaining ring in this region. By means of a circumferential wall that is deliberately thinner in the region of the engagement projection, sufficient spring action is achieved that allows the engagement projection to disengage or engage on an upper bulge-shaped edge of the container neck. However, if the engagement projection were to be attached to the circumferential wall that has a normal wall thickness, it would be almost impossible to open the container closure since the pressure exerted by the thumb during opening would increase the adhesive force between the engagement projection and the container neck.

According to a preferred design, the deformable region is surrounded in the circumferential direction by two reinforcing regions of the circumferential wall that connect the gripping projection to an outer edge of the end plate. The forces of the thumb pressing on the gripping projection during opening are transferred to the end plate by the reinforcing regions without an inhibitory effect between the engagement projection and the container neck. In order to achieve this reinforcement, each of the reinforcing regions of the circumferential wall can have a wall thickness that is greater than the wall thickness of the upper wall portion and then the wall thickness of the lower wall portion. According to a preferred embodiment, each of the reinforcing regions of the circumferential wall comprises at least one reinforcement rib, which runs in parallel with the reference axis, extends outward from the circumferential wall and connects the gripping projection to an outer edge of the end plate. The deformable region preferably comprises lateral wall portions on either side of the engagement projection in the circumferential direction, which connect the engagement projection to the reinforcing regions. The wall thickness of the lower wall portion, the wall thickness of the upper wall portion and optionally a wall thickness of the lateral wall portions are preferably less than 20% of a wall thickness of the reinforcing regions of the circumferential wall.

The engagement projection is preferably curved to facilitate engagement and disengagement upon contact with the edge of the neck of the container.

The invention also relates to a sealed container comprising a neck, which comprises a circumferential flanged rim, a neck edge and a retaining bulge, wherein the neck is closed by the above-described container closure, wherein the retaining ring sits between the retaining bulge and the flanged rim, the engagement projection engages behind the neck edge and the inner surface of the end plate sits on the neck edge. The wall thickness of the lower wall portion, the wall thickness of the upper wall portion and optionally the wall thickness of the lateral wall portions are determined such that the force needed to resiliently move the engagement projection radially can be determined regardless of the other shape of the closure, in particular of the thickness of the end plate and the thickness of the circumferential wall, such that these elements of the container closure can give the container closure the strength to withstand the strain of the logistical process.

BRIEF DESCRIPTION OF THE DRAWINGS

Embodiments of the present invention will be described with reference to the attached drawings, in which.

In all the drawings, individual reference numerals denote the same or similar elements.

DETAILED DESCRIPTION OF ONE EMBODIMENT

Figure 4:
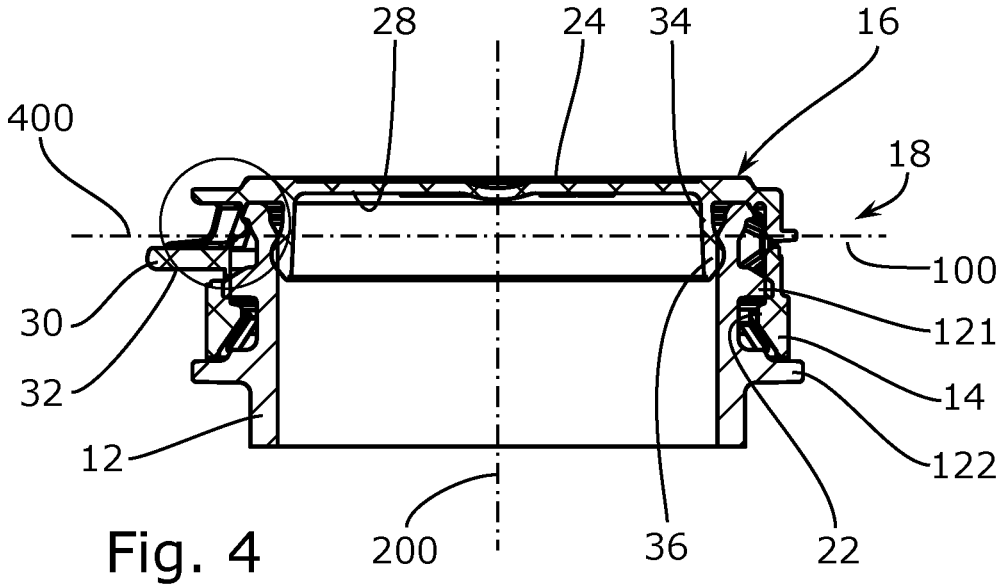
FIG. 4 is a lateral sectional view of the container closure in FIG. 1 on the neck of a container in the closed position.

With reference to the drawings, a preferred embodiment of a container closure according to the present invention is characterized by reference numeral 10. The closure 10 is intended to be mounted on the neck 12 of a container, as shown in FIG. 4. The neck 12 usually has a rotationally symmetrical design. The closure 10 can be made of a plastics material or a different material that is compatible with the contents of the container. In this case, a polymer, in particular a thermoplastic plastics such as polyethylene or polypropylene, is preferred.

The container closure 10 comprises a retaining ring 14, a cap part 16 and a hinge 18, which connects the retaining ring 14 to the cap part 16. The hinge 18 is shown as a snap hinge here and allows the cap part 16 to pivot about a pivot axis that extends perpendicularly to the sectional plane in FIG. 4. The retaining ring 14, the cap part 16 and the hinge 18 are cast together in one piece in the closed position and the cap part 16 is connected to the retaining ring 14 by means of tearable bridges 20.

The retaining ring 14 surrounds a reference axis 200 of the container closure 10 and comprises means intended to be fastened to the container neck 12, in this embodiment a number of resilient engagement hooks 22 that are distributed on the circumference of the retaining ring and engage behind a circumferential retaining bulge 121 of the container neck when mounted on the container neck and sit between this retaining bulge 121 and a flanged rim 122 of the container neck, also known as a "support ring" in technical jargon (see FIG. 4). Other means are, however, conceivable, for example a circumferential fixing bulge or a thread.

Figure 1:
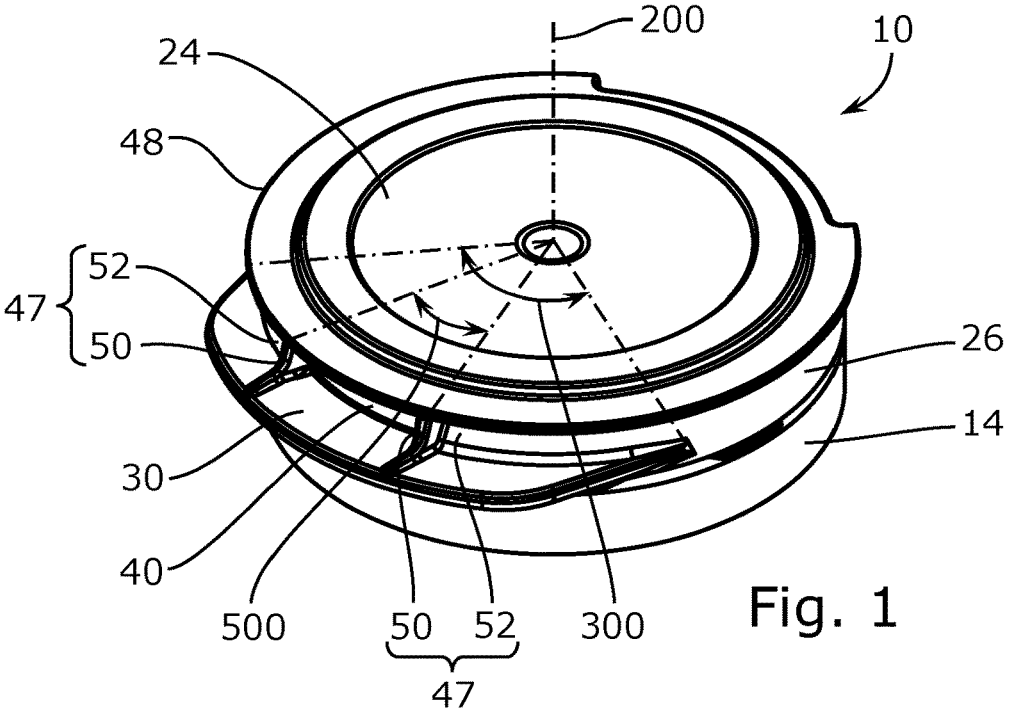
FIG. 1 is a perspective view of one embodiment of the container closure in a closed position.
Figure 2:
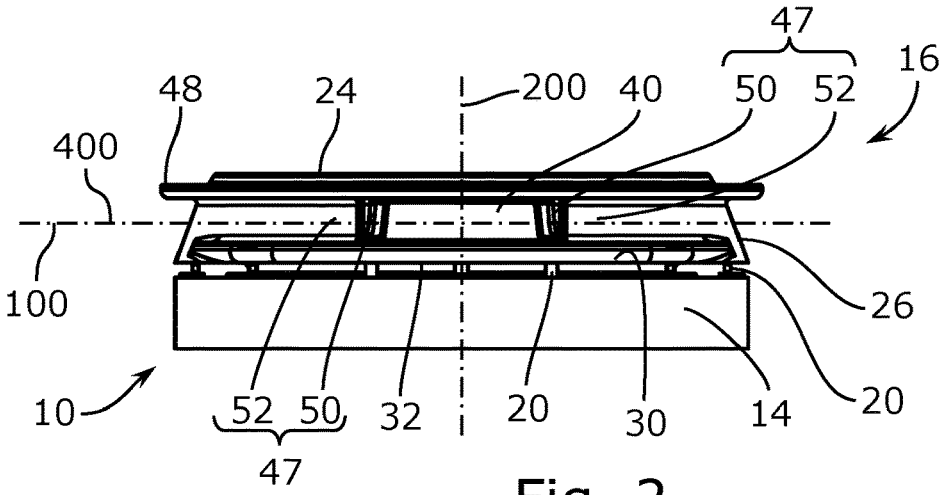
FIG. 2 is a front view of the container closure in FIG. 1 in the closed position.
Figure 3:
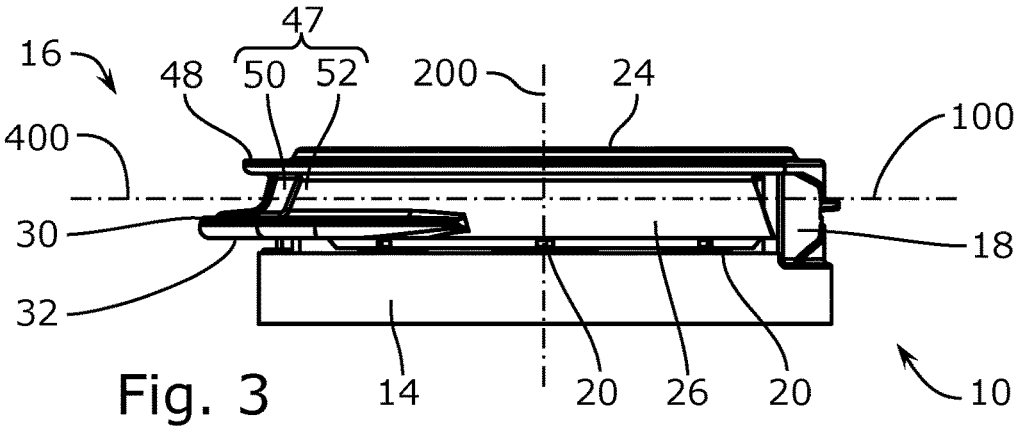
FIG. 3 is a lateral view of the container closure in FIG. 1 in the closed position.

The cap part 16 comprises an end plate 24, a circumferential wall 26, which surrounds an inner wall surface 28 of the end plate 24, and a gripping projection 30, which extends radially outward from the circumferential wall 26 at an axial spacing from the end plate 24. In this embodiment, the gripping projection 30 extends radially outward from the lower edge of the circumferential wall 26 that is opposite the end plate 24 and extends around the reference axis 200 at an angle 300 (see FIG. 1) of more than 60°, preferably more than 90°. The gripping projection 30 comprises a smooth, preferably flat, lower surface 32, which forms a comfortable surface for the user to press their thumb on during opening. This lower surface 32 is arranged on a side of a transverse plane 400 (see FIG. 2) that is opposite the end plate 24, extends transversely to the reference axis 200 and contains the pivot axis 100. This ensures that, when opening the closure 10, the initial movement of the gripping projection 30 occurs virtually perpendicularly to the transverse plane 400 and in parallel with the reference axis 200.

The end plate 24 can be flat or curved. An annular sealing skirt 34 extends from the inner side 32 of the end plate 24 (see FIG. 4) and is surrounded by the circumferential wall 26 at a radial spacing therefrom. This sealing skirt 34 is intended to engage in the interior of the container neck 12 when the container closure 10 is placed on the container neck 12 and the cap part 16 is in the closed position. The sealing skirt 34 can comprise a circumferential bulge 36.

Figure 5:
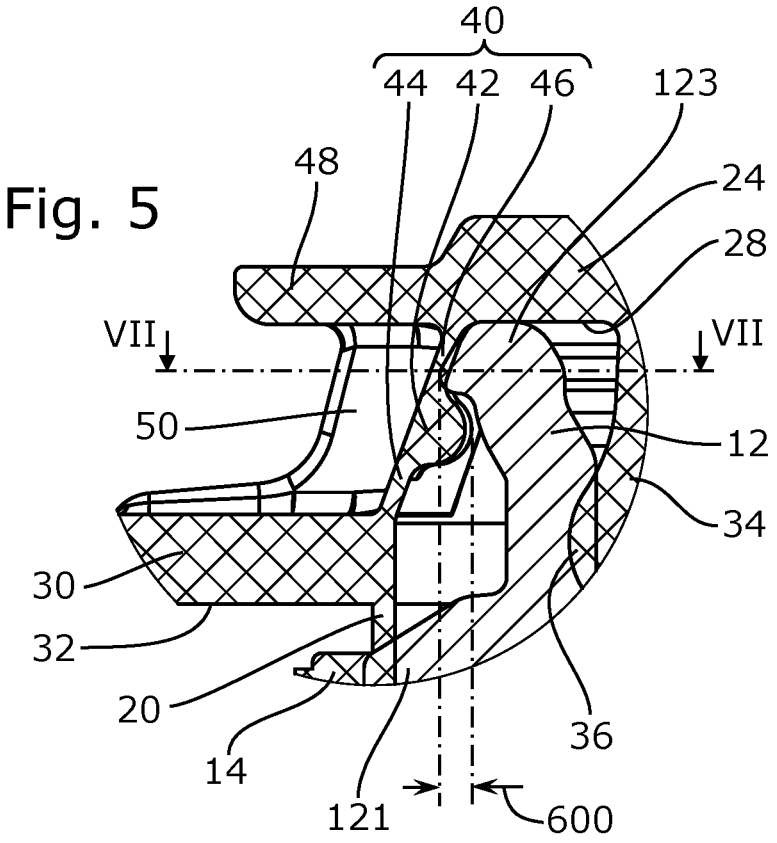
FIG. 5 is a detailed view of a region circled in FIG. 4.
Figure 6:
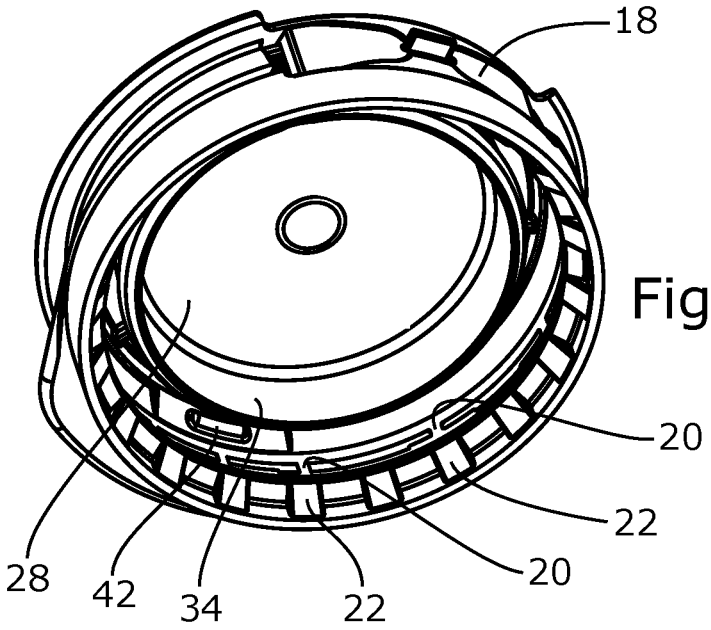
FIG. 6 is another perspective view from below of the container closure in FIG. 1 in the closed position.
Figure 7:
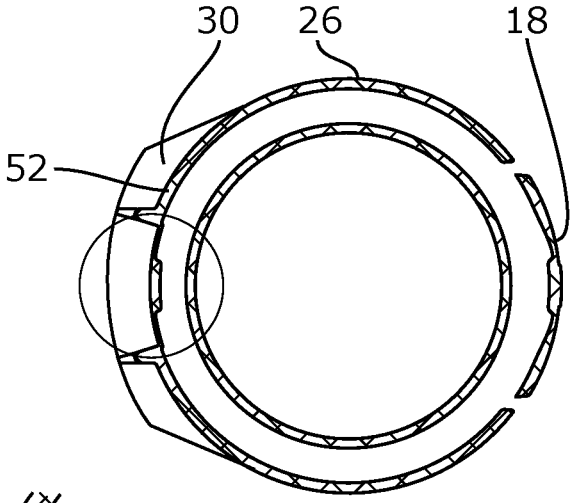
FIG. 7 is a sectional view of the container closure through a cross-sectional plane VII-VII extending transversely to a reference axis of the container closure.
Figure 8:
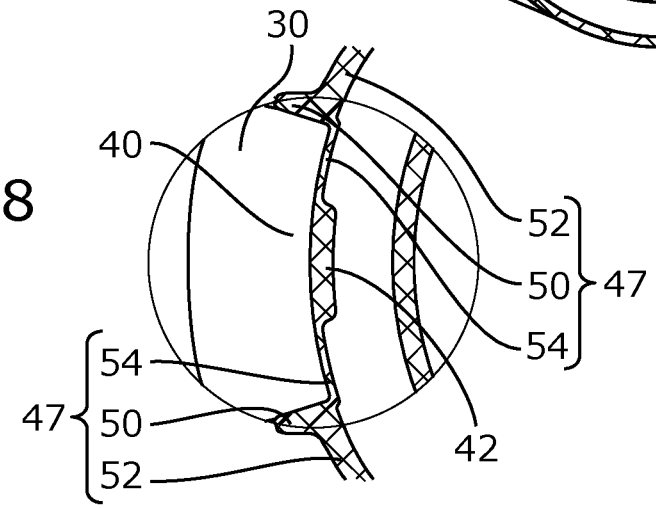
FIG. 8 is a detailed view of a region circled in FIG. 7.

According to the invention, the circumferential wall 26 comprises a deformable region 40 that lies diametrically opposite the hinge 18 and extends between the end plate 24 and the gripping projection 30. The deformable region 40 in particular consists of a curved engagement projection 42 that is directed radially inward, a lower wall portion 44 between the engagement projection 42 and the gripping projection 30 and an upper wall portion 46 between the engagement projection 42 and the end plate 24. The engagement projection 42 is supposed to find an engagement position beneath the upper edge 123 of the container neck. As can be seen in FIGS. 4 and 5, the upper edge 123 of the container neck 12 can rest directly on the lower surface 28 of the end plate 24.

The deformable region 40 extends circumferentially at an angle 500 of less than 60°, preferably less than 45° (see FIG. 1) such that the gripping projection 30 extends on either side of the deformable region 40 in the circumferential direction. The deformable region 40 is surrounded by two reinforcing regions 47 of the circumferential wall 26 in the circumferential direction that connect the gripping projection 30 to an outer rim 48 of the end plate 24. Each reinforcing region 47 comprises a reinforcement rib 50, which extends outward from the circumferential wall 26 and runs in parallel with the reference axis 200 in order to connect the gripping projection 30 to the outer rim 48 of the end plate 24, and a reinforced wall portion 52, the wall thickness of which is greater than the wall thickness of the upper wall portion 46 and than the wall thickness of the lower wall portion 44.

The engagement projection 42 of the deformable region 40 is circumferentially spaced apart from the reinforcing regions 46 and is connected to the reinforcing regions 47 by means of thin lateral wall portions 54, which are flush with an inner surface 55 of the reinforced wall portion 52 or protrude slightly inward.

The wall thickness of the upper wall portion 46, of the lower wall portion 44 and of the lateral wall portions 54 of the deformable region 40 are determined such that the engagement projection can move radially outward as a result of elastic deformation of the deformable region 40, specifically such that the engagement projection 42 can slide past the upper edge 123 during opening and re-closing. In practice, the upper edge 123 extends almost as far as the upper wall portion 46 in the radial direction, and the radial extension 600 of the engagement projection 44 (see FIG. 5) is a measure of the desired radial movement of the engagement projection. Depending on the shape of the upper edge 123, the engagement projection 44 is intended to be able to move for more than 50%, preferably more than 90%, of the radial extension 600 of the engagement projection 44.

Therefore, when opening and re-closing the cap part 24, the curved engagement projection 42 can be easily engaged and disengaged as a result of the contact with the edge 12 of the neck of the container. In particular, a desired haptic and, if necessary, audible signal is given when the engagement projection 42 passes the dead center and the deformable region suddenly expands when the closed position is reached. During opening, the forces exerted by the thumb on the lower side 32 of the gripping projection 30 are transferred to the end plate 24 by the lateral reinforcing regions 47, while the deformable region 40 deforms outward and yields without substantially affecting the opening movement despite the fact that the engagement projection 42 is moved in the opposite direction to the finger pressure.

Of course, the wall thicknesses of the wall portions 44, 46, 54 of the deformable region 40 and the radial extension 600 of the inner engagement projection 44 can be tailored to the geometric conditions of the container neck in order to generate the desired signal.

The engagement projection 42 also helps maintain the closed position even though the opening resistance is actually generated by the elastic deformation of the sealing skirt 34 in the neck 12.

The invention claimed is:

1. A container closure, comprising:

a retaining ring that extends around a reference axis of the container closure;

a cap part; and a hinge that connects the retaining ring to the cap part, the cap part comprising an end plate, a circumferential wall that surrounds an inner surface of the end plate and a gripping projection that extends radially outward from the circumferential wall and extends axially at a spacing from the end plate, wherein the circumferential wall comprises a deformable region that is diametrically opposite the hinge and extends between the end plate and the gripping projection, wherein the deformable region comprises an engagement projection that protrudes radially inward, a lower wall portion arranged between the engagement projection and the gripping projection and an upper wall portion that is arranged between the engagement projection and the end plate, wherein a wall thickness of the upper wall portion and a wall thickness of the lower wall portion are such that elastic deformation of the deformable region allows for a radially outward movement of the engagement projection for more than fifty percent of a radial extension of the engagement projection, wherein the deformable region is surrounded in the circumferential direction by two reinforcing regions of the circumferential wall that connect the gripping projection to the end plate, and wherein each of the reinforcing regions has a wall thickness that is greater than both the wall thickness of the upper wall portion and the wall thickness of the lower wall portion.

2. The container closure in accordance with claim 1, wherein each of the reinforcing regions of the circumferential wall comprises at least one reinforcement rib, which runs in parallel with the reference axis, extends outward from the circumferential wall and connects the gripping projection to the end plate.

3. The container closure in accordance with claim 1, wherein the deformable region comprises lateral wall portions on either side of the engagement projection in the circumferential direction, which connect the engagement projection to the reinforcing regions of the circumferential wall.

4. The container closure in accordance with claim 1, wherein the wall thickness of the lower wall portion, the wall thickness of the upper wall portion and optionally a wall thickness of the lateral wall portions are less than 20% of a wall thickness of the reinforcing regions of the circumferential wall.

5. The container closure in accordance with claim 1, wherein the lower wall portion, the upper wall portion and optionally the lateral wall portions rest flush against an inner surface of the circumferential wall or protrude radially inward.

6. The container closure in accordance with claim 1, wherein the engagement projection is curved.

7. The container closure in accordance with claim 1, wherein the upper wall portion has a wall thickness that is less than the wall thickness of the lower wall portion.

8. The container closure in accordance with claim 1, wherein the deformable region extends around the reference axis at an angle of less than 60°.

9. The container closure in accordance with claim 1, wherein the gripping projection extends around the reference axis at an angle of more than 60°.

10. The container closure in accordance with claim 1, wherein the cap part, the hinge and the retaining ring are integrally connected to one another.

11. The container closure in accordance with claim 1, wherein the hinge is a snap hinge.

12. The container closure in accordance with claim 1, wherein the gripping projection extends outward from a lower edge of the circumferential wall.

13. The container closure in accordance with claim 1, wherein an inner sealing skirt, which proceeds from the inner surface of the end plate, extends radially inside the circumferential wall.

14. The container closure in accordance with claim 1, wherein the cap part is directly connected to the retaining ring by means of breakable bridges or a breakable continuous line of weakness.

15. The container closure in accordance with claim 1, wherein said closure is produced as one piece of plastic.

16. A sealed container comprising a neck, comprising a circumferential flanged rim, a neck edge and a retaining bulge, wherein the neck is closed by a container closure of claim 1, the retaining ring sitting between the retaining bulge and the flanged rim, the engagement projection engaging behind the neck edge and the inner surface of the end plate sitting on the neck edge.

* * * * *